US005120198A

United States Patent [19]

Clark

[11] Patent Number: 5,120,198

[45] Date of Patent: Jun. 9, 1992

[54] PUMP MOTOR CONTROL RESPONSIVE TO CONDUCTIVE FLOW SWITCH AND DUAL TIMERS

[76] Inventor: Fayette M. Clark, 4845 Manor Ct. #4, Cape Coral, Fla. 33904

[21] Appl. No.: 733,445

[22] Filed: Jul. 22, 1991

[51] Int. Cl.[5] ..... F04B 49/06

[52] U.S. Cl. ..... 417/12; 417/18; 417/36; 417/40; 417/43; 340/606

[58] Field of Search ..... 417/12, 18, 20, 36, 417/40, 43, 44; 340/606

[56] References Cited

U.S. PATENT DOCUMENTS 2,981,195 4/1961 Payne, II et al. ..... 417/20
4,676,914 6/1987 Mills et al. ..... 417/12
4,881,873 11/1989 Smith et al. ..... 417/12
5,076,763 12/1991 Anastos et al. ..... 417/36

*Primary Examiner*—Richard A. Bertsch
*Assistant Examiner*—David W. Scheuermann

[57] ABSTRACT

A protector device connected in series with a pool pump motor. When the automated pool timer contacts close, supplying AC power to pool pump motor, the protector apparatus logic permits instantaneous motor turn on and logic reset of apparatus clock timer. After a nominal period of time, pump motor will be shut off, unless water is flowing through pump motor. In the event water is flowing through pump motor, a water flow sensing switch in the water line to pump will override clock logic, and hold pump motor on, until the automated pool timer reaches a preset trip turn off time.

1 Claim, 1 Drawing Sheet

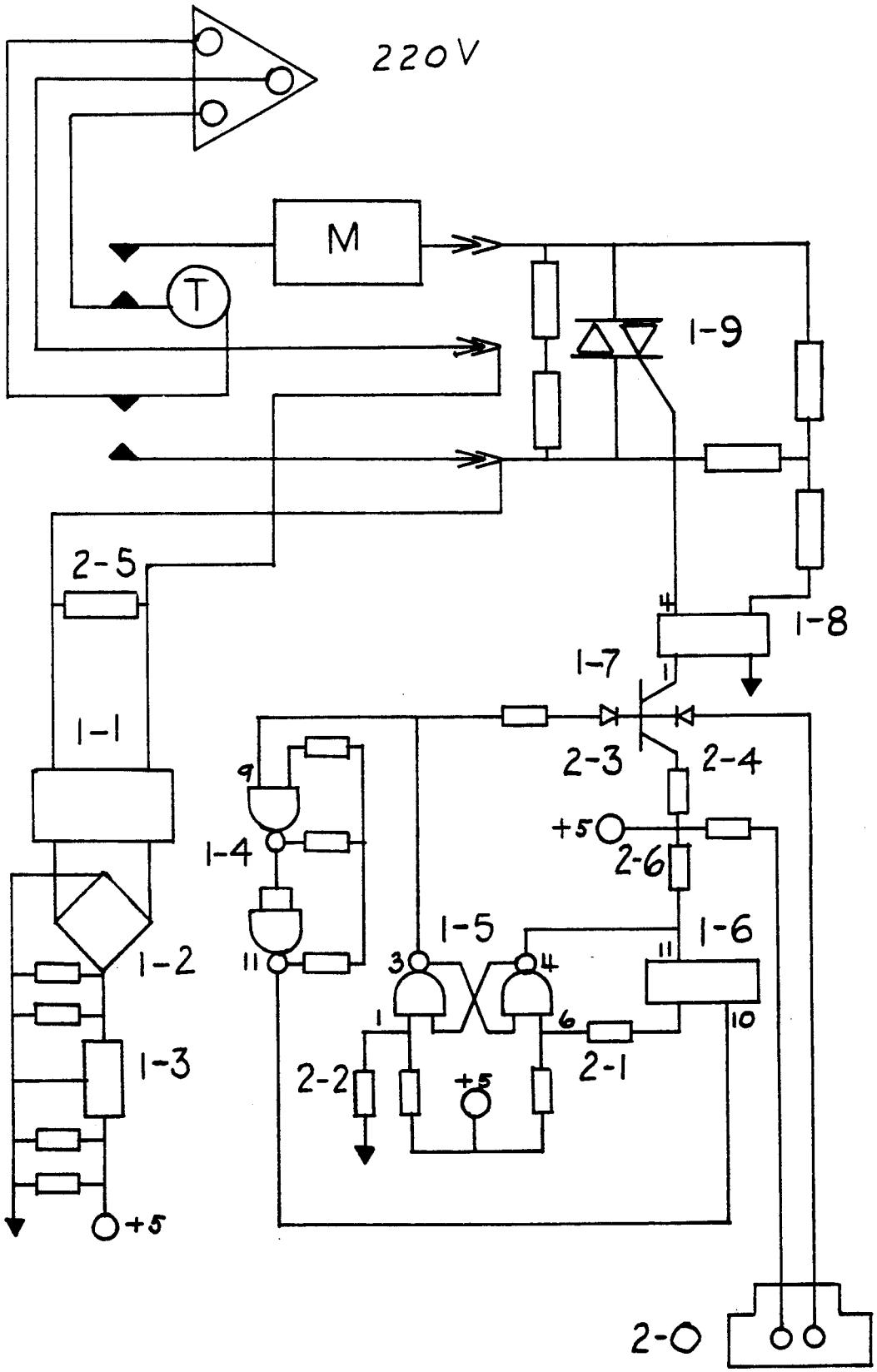
220V
M
T
1-9
2-5
1-8
1-7
1-1
2-3
2-4
1-4
+5
2-6
1-5
1-6
1-2
1-3
2-2
2-1
+5
+5
2-0

PUMP MOTOR CONTROL RESPONSIVE TO CONDUCTIVE FLOW SWITCH AND DUAL TIMERS

BACKGROUND OF THE INVENTION

1. Field of the Invention

The present invention relates to a protection apparatus for swimming pool recirculating pump motors. More specifically, the present invention relates to an electronic clock device and a water flow sensing switch, used to start up and shut down a pool pump motor, after a nominal period of time of negative water flow.

2. Prior Art

No apparatus is known for protecting pool pump motors in this manner.

SUMMARY OF THE INVENTION

The principal object of the present invention is to provide an apparatus to protect automated swimming pool recirculating pump motors for effective and safe operation. It is also the object of the invention to provide such a device which is of simple and inexpensive construction. Another object is to provide such a device in lightweight form that can be installed quickly and easily on site. A further object is to provide such a device which when in use will decrease the loss of expensive pump motors. The forgoing objects can be accomplished by providing an electronic clock apparatus, controlling the length of time between motor start up and shut off, and a water flow sensing switch for continuous enabling of pump motor. In the preferred embodiment of the invention, the standard is formed by a closed loop of logic circuits which form a clock apparatus, to enable or disable the pump motor when there is no water flowing. A further embodiment is the connection between the clock device, and the optoisolator connected and controlled by the clock apparatus, and the electrically operated traic providing power to the pump motor for a limited amount of time, the water flow sensing switch circuit connected to the same point through a steering diode will enable the pump motor, (if there is water flowing during the brief clock time), provide continuous power to the pool pump motor. The electronics are powered by a step down isolation transformer 115 to 12 volts AC, controlled by an automated pool timer. The 12 volts AC is recified, filtered, and regulated at a constant 5 volts DC which provides automatic reset of logic circuits on turn on, and also provides power to the water flow sensing switch, as well as the logic circuits.

BRIEF DESCRIPTION OF THE DRAWING

The sole FIGURE is an electronic schematic in accordance with the present invention.

DETAILED DESCRIPTION

As shown on the electronic schematic there is a 220 volt AC power source, with a 220 volt AC 24 hour clock motor connected to said 220 volt AC source, said 220 volt AC 24 hour clock motors normally open contacts are connected to a 220 volt AC pump motor. Said 220 volt AC pump motor is supplyed 220 volt AC power, when said 220 volt AC 24 hour clock motor contacts close. Operation of said 220 volt AC pump motor is controlled by a traic 1-9 power switch, which in turn is controlled by a optisolator 1-8. A 115 volt AC power source is formed by picking up one side of 220 volt AC off the lower normally open contact of said 220 volt AC 24 hour clock motor contact as shown in schematic, and ground. Said 115 volt AC power source is voltage spike suppressed, with 2-5 a transient/surge absorber. Said 115 volt AC is connected to a 115 to 12 volt step/down isolation transformer 1-1. Said 12 volt AC is then rectified 1-2, filtered, and regulated 1-3, at plus 5 volts DC. Said plus 5 volts is used to supply the short duration timer control circuits, and the resistance sensing flow switch. Control of the pump operations is achieved by means of the following assemblage of major circuit stages, to form a timer of short duration with a dual forced reset. Circuits 1-4 a astable oscillator, 1-5 a R/S flip flop, 1-6 a binary counter, 2-2 a reset capacitor, 2-6 a reset capacitor, 2-1 a decoupling/set capacitor. 1-5 R/S flip flop is the control center of the timer operation, because it is the reset/and set of the timer. Said 220 volt AC 24 hour clock motor times "on" once a day, and "off" once a day, every time that it turns "on", power is switched through the normally open contacts of said 24 hour clock supplying both 220 volt AC to pump motor, and 115 volt AC to a 115 to 12 volt step/down isolation transformer 1-1. Said 12 volts AC is condition through rectification 1-2, filtered, and regulated 1-3 at said plus 5 volts DC. When said plus 5 volts DC supplys circuits 1-4, 1-5, 1-6, 2-2, and 2-6, the circuit components 2-2 and 2-6 which are capacitors, are used to force a dual timer and counter reset. By inserting 2-2 between pin 1 the reset of 1-5 and ground, and by inserting 2-6 between said plus 5 volts DC and pin 11 master reset of 1-6. Said component 2-2 being tied to pin 1 reset of 1-5 and ground becomes a momentary low impedance when said plus 5 volts DC is supplyed to said assemblage of major circuits, forcing 1-5 R/S flip flop to reset pin 3 high and pin 4 low. Said component 2-6 being tied to said plus 5 volts DC and pin 11 master reset of 1-6, becomes a momentary high impedance, at the same time as pin 4 of 1-5 is going low forces 1-6 to reset. R/S flip flop 1-5 now at reset pin 3 high, supplies controlling "on" voltage. The controlling power links being components 2-3 and 2-4 steering and blocking diodes, 1-7 transistor emitter driver, 1-8 optisolator, 1-9 traic, 2-1 decoupling set capacitor, and 2-0 resistance sensing flow switch, form the following functions. With pin 3 high of 1-5, supplying a drive voltage through steering and blocking diode 2-3, the voltage is applied to the base of transistor emitter driver, with steering and blocking diode 2-4, blocking the reverse voltage. 1-7 is a low impedance means to supply high drive to optisolator 1-8, which both supplies drive to traic 1-9, and decouples the timers low power from the high power needs of the power switch traic 1-9. Steering and blocking diode 2-4, receives its voltage drive from said plus 5 volts DC supply through a fixed resistor, and a variable water resistance of approximately 10K ohms, when there is water flow. Upon completion of the short duration time of timer, counter 1-6 produces a one pulse trigger through 2-1 a decoupling set capacitor to pin 6 "set" of 1-5 R/S flip flop, disabling 1-6, 1-4, if 2-0 water resistance sensing flow switch, has not sensed delivery of resistance, then delivery of the power source will be disabled and will remain "off" until following day. If said water resistance sensing flow switch 2-0, does sense water flow, a drive voltage from said 2-0 will be supplied through steering and blocking diode 2-4 to transistor base 1-7, with steering and blocking diode 2-3 blocking reverse voltage. With water flow secure, 220 volt AC pump motor will continue to operate until said 24 hour clock reaches its preset time "off" at end of the day.

I claim:

1. An apparatus for controlling the operation of a pump motor, said pump motor being controlled by a circuit comprising:

a power source;

a 24 hour timer connected to said power source, for timing a period of "on" and a period of "off" each 24 hours;

an isolated DC voltage supply;

an off-delay timer, powered by the DC supply which times out after a pre-set time period has elapsed and is reset at the beginning of every "on" period of the 24 hour timer;

a flow sensing switch connected to the DC supply, having a pair of electrodes located in a pump fluid conduit, said electrodes indicate flow by a change in resistance across said electrodes; and a control circuit for insertion in said power source, said control circuit being connected to enable the delivery of power from said power source to said pump motor beginning when the 24 hour timer "on" period occurs, and to disable the delivery of power at the beginning of the 24 hour timer "off" period, and to disable the delivery of power from said power source to said pump motor during the "on" period after said off-delay timer has timed out and in response to the absence of flow until the beginning of the next "on" period.

* * * * *